US007534014B1

(12) United States Patent
Pelletier et al.

(10) Patent No.: US 7,534,014 B1
(45) Date of Patent: May 19, 2009

(54) HELICOIDAL SYSTEM FOR RECESSED LIGHT FIXTURE ASSEMBLY

(75) Inventors: Marc Pelletier, St-Jean-Chrysostome (CA); Jacques Mercier, Quebec (CA); Jayson Auger, Levis (CA)

(73) Assignee: Eclairage Contraste, St-Jean-Chrysostome, Quebec (CA)

( * ) Notice: Subject to any disclaimer, the term of this patent is extended or adjusted under 35 U.S.C. 154(b) by 0 days.

(21) Appl. No.: 12/006,957

(22) Filed: Jan. 8, 2008

(30) Foreign Application Priority Data

Nov. 26, 2007 (CA) ..... 2612346

(51) Int. Cl.
*F21V 17/14* (2006.01)
*F21S 8/02* (2006.01)

(52) U.S. Cl. ..... 362/368; 362/365; 362/147

(58) Field of Classification Search ..... 362/145, 362/147, 260, 364, 365, 368
See application file for complete search history.

(56) References Cited

U.S. PATENT DOCUMENTS 5,377,086 A * 12/1994 Tickner ..... 362/235
5,826,970 A * 10/1998 Keller et al. ..... 362/147
6,899,445 B2 * 5/2005 Hyder ..... 362/368

FOREIGN PATENT DOCUMENTS

CA 2088648 3/1995

* cited by examiner

*Primary Examiner*—Hargobind S Sawhney
(74) *Attorney, Agent, or Firm*—Boyle Fredrickson, S.C.

(57) ABSTRACT

The disclosure herein describes a helicoidal system for securing a recessed light fixture assembly into an opening in a ceiling, wall or the like; the assembly comprises a light reflector having an upper collar and a light reflector support for mounting the light reflector into the opening of the ceiling, wall or the like. The light reflector support has an upper member that engages the upper part of the light reflector and has a helicoidal bearing surface to receive lugs provided on the light reflector whereby rotation of the light reflector, once received in the light reflector support, enables engagement in one rotational direction, and disengagement in an opposite rotational direction, of the light reflector to and from the reflector support.

7 Claims, 6 Drawing Sheets

HELICOIDAL SYSTEM FOR RECESSED LIGHT FIXTURE ASSEMBLY

FIELD OF THE INVENTION

The present invention relates to a helicoidal system for securing a recessed light fixture into an opening in a ceiling, wall or the like.

BACKGROUND OF THE INVENTION

Recessed light fixtures consist of a pot or reflector which is inserted into an opening made in a ceiling, wall or the like so that the light emitting device is recessed with respect to the ceiling or wall plane. A light fixture assembly usually consists of a light reflector and a reflector support, the latter including various types of fastening devices to mount the light fixture to the ceiling or wall. One such fastening device is described in applicant's Canadian Patent No. 2,088,648 issued Mar. 28, 1995 which is incorporated herein by reference.

The method usually performed by light fixture manufacturers for mounting or dismounting the light reflector to its support is accomplished by means of claws or clips which occasionally damage the reflecting surface of the light reflector. This operation thus requires some skill to prevent such damage. Also, indexing means are usually needed to ensure a proper engagement of the light fixture in the ceiling or wall opening.

OBJECTS AND STATEMENT OF THE INVENTION

It is an object of the present invention to overcome the present problems associated with installing reflectors to their support in recessed light fixture assemblies.

It is also an object of the present invention to provide a light fixture assembly wherein the installation of the reflector to its support is easily accomplished without damaging the reflecting surface of the reflector as well as insuring each time a perfect installation.

This is achieved by providing a recessed light fixture assembly which comprises:

- a light reflector having an upper part and engaging means mounted to the upper part of the light reflector; and
- a light reflector support adapted to be mounted into the opening of the ceiling, wall or the like; the reflector support having an upper part adapted to engage the upper part of the light reflector; the upper part of the light reflector support having a bearing surface cooperatingly receiving the engaging means of the upper part of the light reflector; the bearing surface of the upper part of the light reflector support having an helicoidal shape whereby rotation of the light reflector, once said upper part of the light reflector bears with the upper part of the light reflector support, enables engagement in one rotational direction and disengagement in an opposite rotational direction, of the light reflector to and from the reflector support.

In one form of the invention, the helicoidal shape surface of the support consists of two helicoidal sections which are diametrically opposed to one another.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

DESCRIPTION OF PREFERRED EMBODIMENTS

Figure 1:
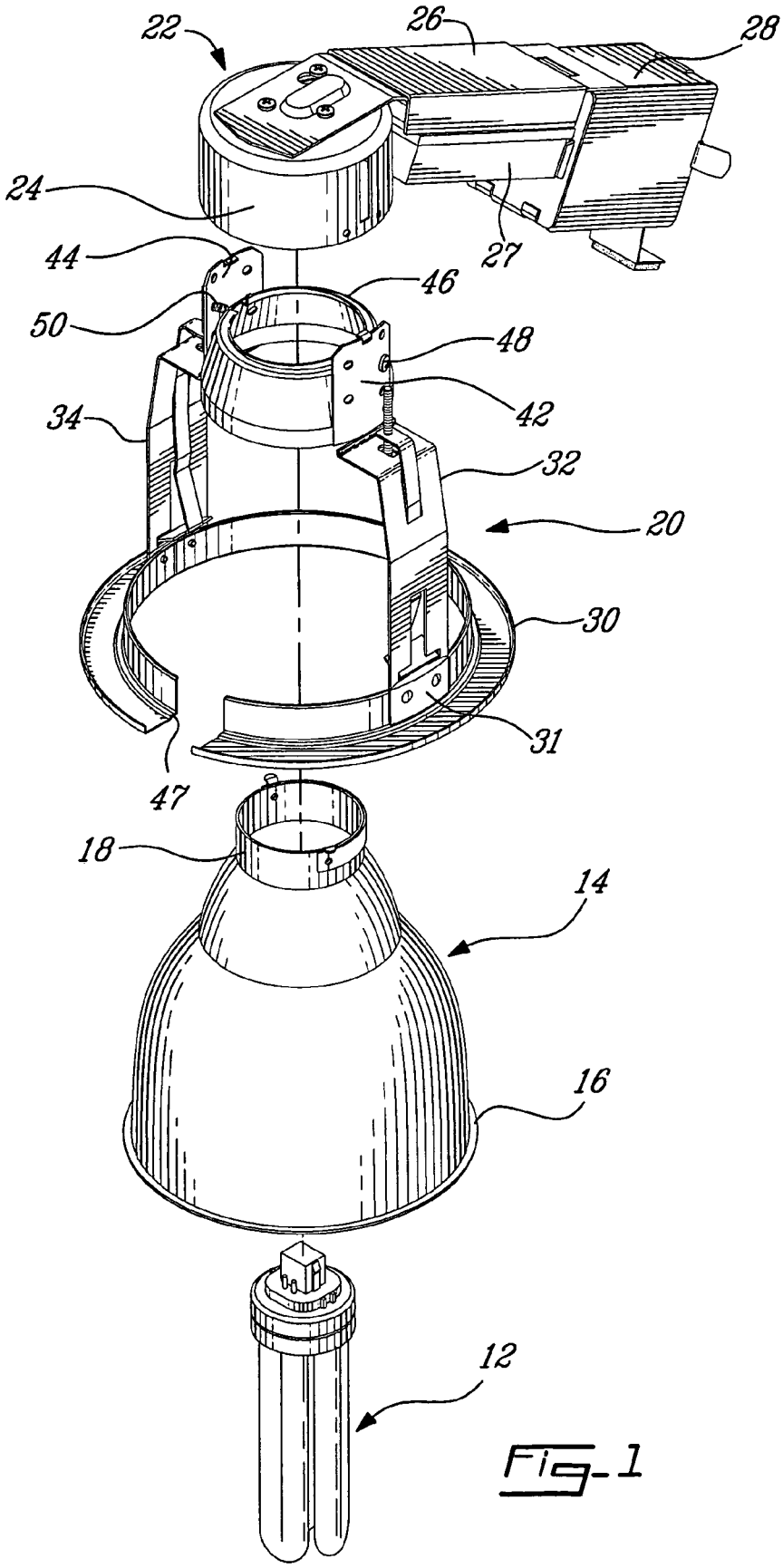
FIG. 1 is an exploded view of a light fixture assembly incorporating the present invention with accessory electrical components.

Referring to FIG. 1, there is shown various components of one embodiment of a light fixture assembly associated with the present invention. It includes a light bulb 12, a light reflector 14 displaying a lower peripheral flange 16 and an upper annular collar 18, a reflector support 20 and a top assembly 22 of electrical components that includes a cap 24 for connecting the light bulb 12, an intermediate section 26 supporting a ballast 27, and a housing 28 containing electrical components for the light bulb.

Figure 2:
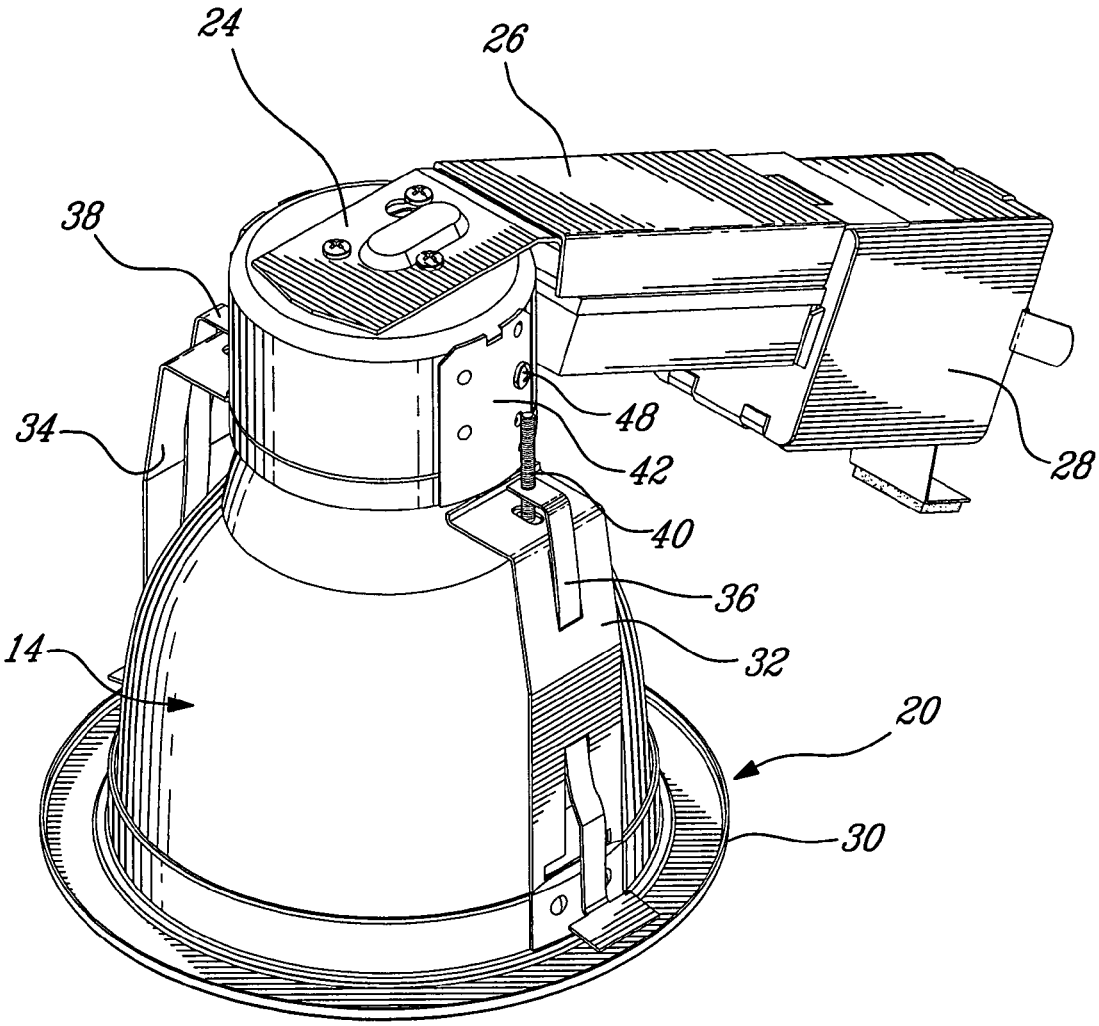
FIG. 2 is an assembled perspective view of the light fixture assembly of FIG. 1.

FIG. 2 shows the various components of FIG. 1 once assembled.

Referring to FIGS. 1 and 2, the reflector support 20 includes a lower annular flange member 30, to which is connected the lower ends (one of which being shown as 31) of a pair of opposite hooks 32 and 34, and an upper annular member 46 which is connected to the upper end portions 42 and 44 of the hooks. Fastening means, such as screws 48 and 50, secure the hooks 32 and 34 to the upper annular member 46 and the cap 24. As shown in FIG. 1, the annular member 30 displays an inner peripheral recess 47, the use of which will be described further hereinbelow.

Figure 4:
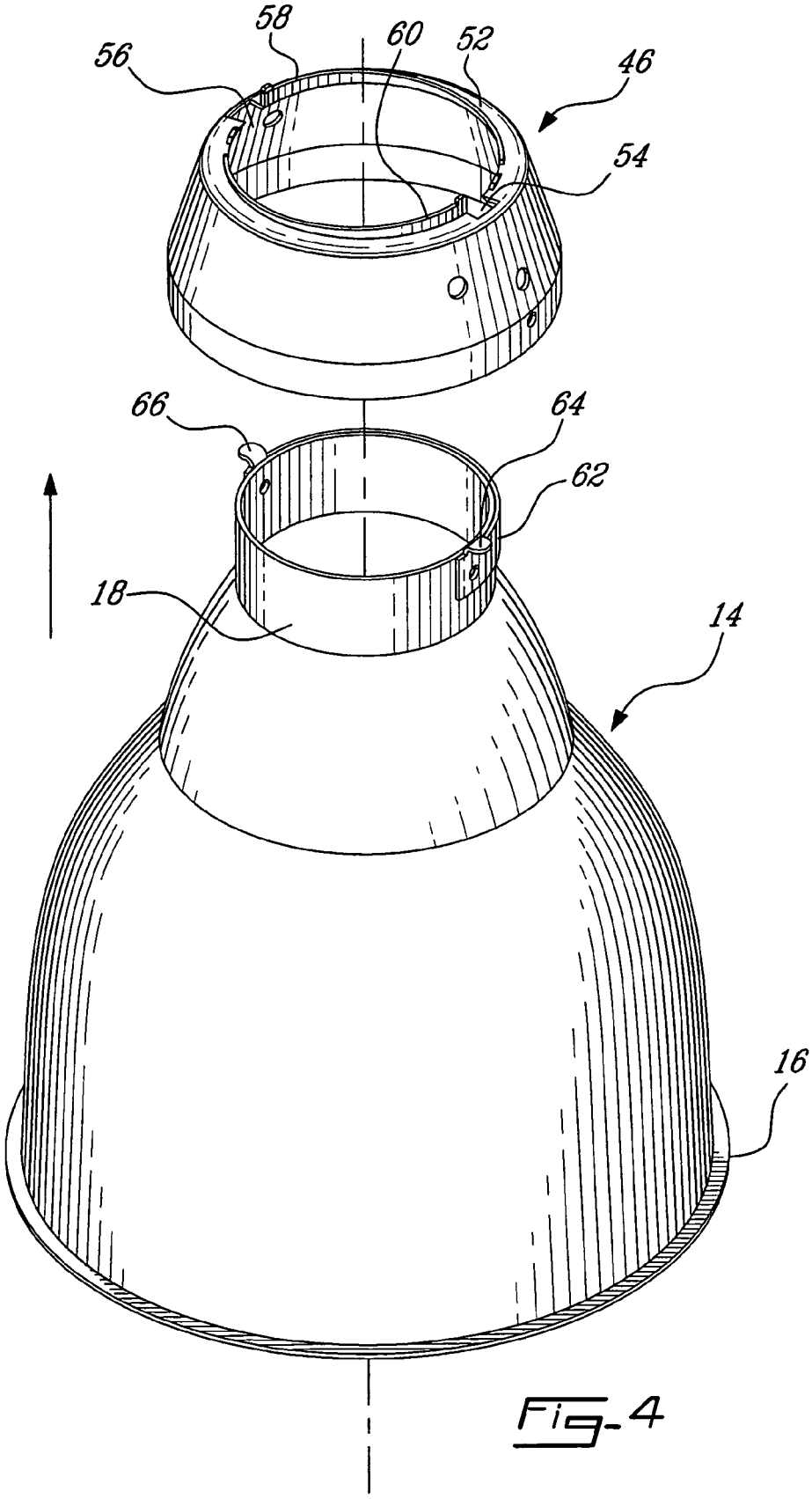
FIG. 4 is an exploded view of the light reflector and the annular member of the support, prior to installation.

Referring to FIG. 4, the annular member 46 has a top surface 52 displaying a pair of opposite slots 54 and 56 and a pair of opposite helicoidal sliding surface 58 and 60, the function of which will be described further hereinbelow.

A semi-circular member 62 is secured to the upper collar 18 of the light reflector and displays a pair of opposite projecting lugs 64 and 66.

Figure 3:
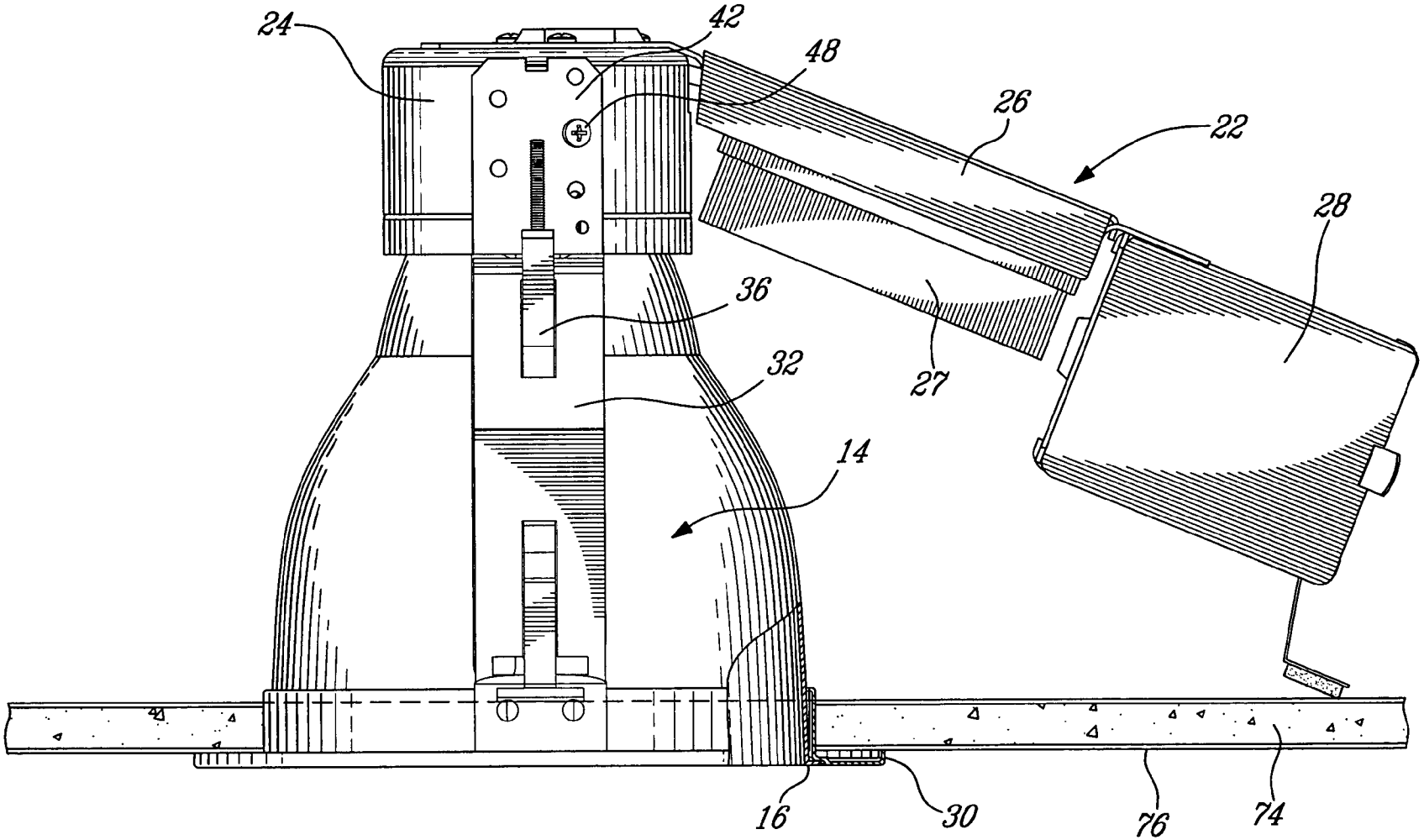
FIG. 3 is a side elevational view of the light fixture assembly of FIG. 2 shown recessed within a ceiling or wall.

The method of installation of the light fixture assembly according to the present invention will now be described. FIG. 3 shows a ceiling or wall 74 with an opening into which is first inserted the reflector support 20 to which is connected the top assembly 22. The manner of securing these components into the opening of the ceiling or wall 72 is accomplished by means of the hooks 32 and 34 and their associated components, clips 36 and 38 and screws (one of which being shown as 40). This installation, which results in having the inner face of flange 30 bearing against the front face wall 76, may be found described in the above mentioned Canadian patent issued to applicant.

The further installation of the light reflector 14 to its support 20 will now be described with reference to FIGS. 5 and 6.

Figure 5:
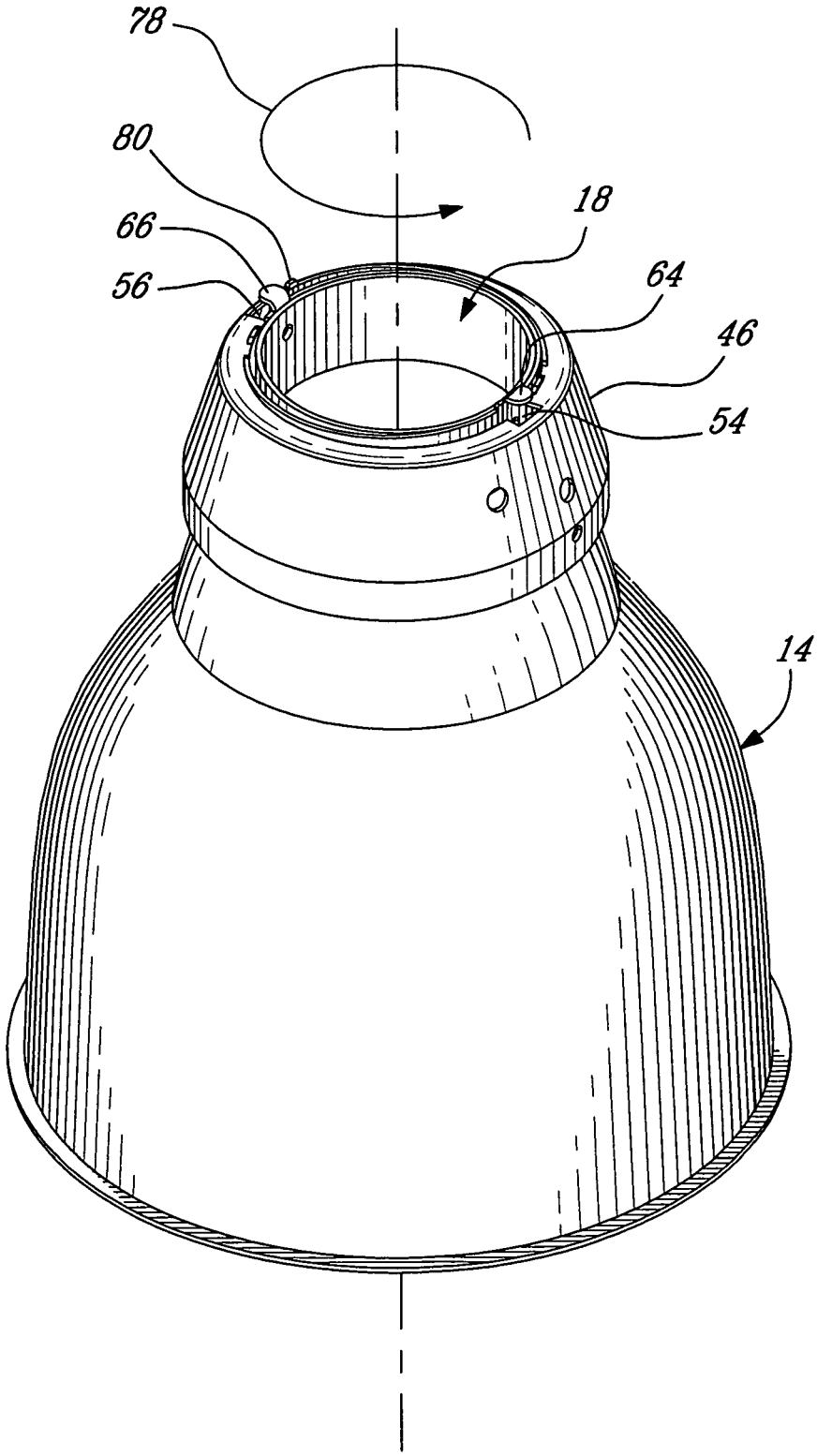
FIG. 5 is a view similar to FIG. 4 during installation.
Figure 6:
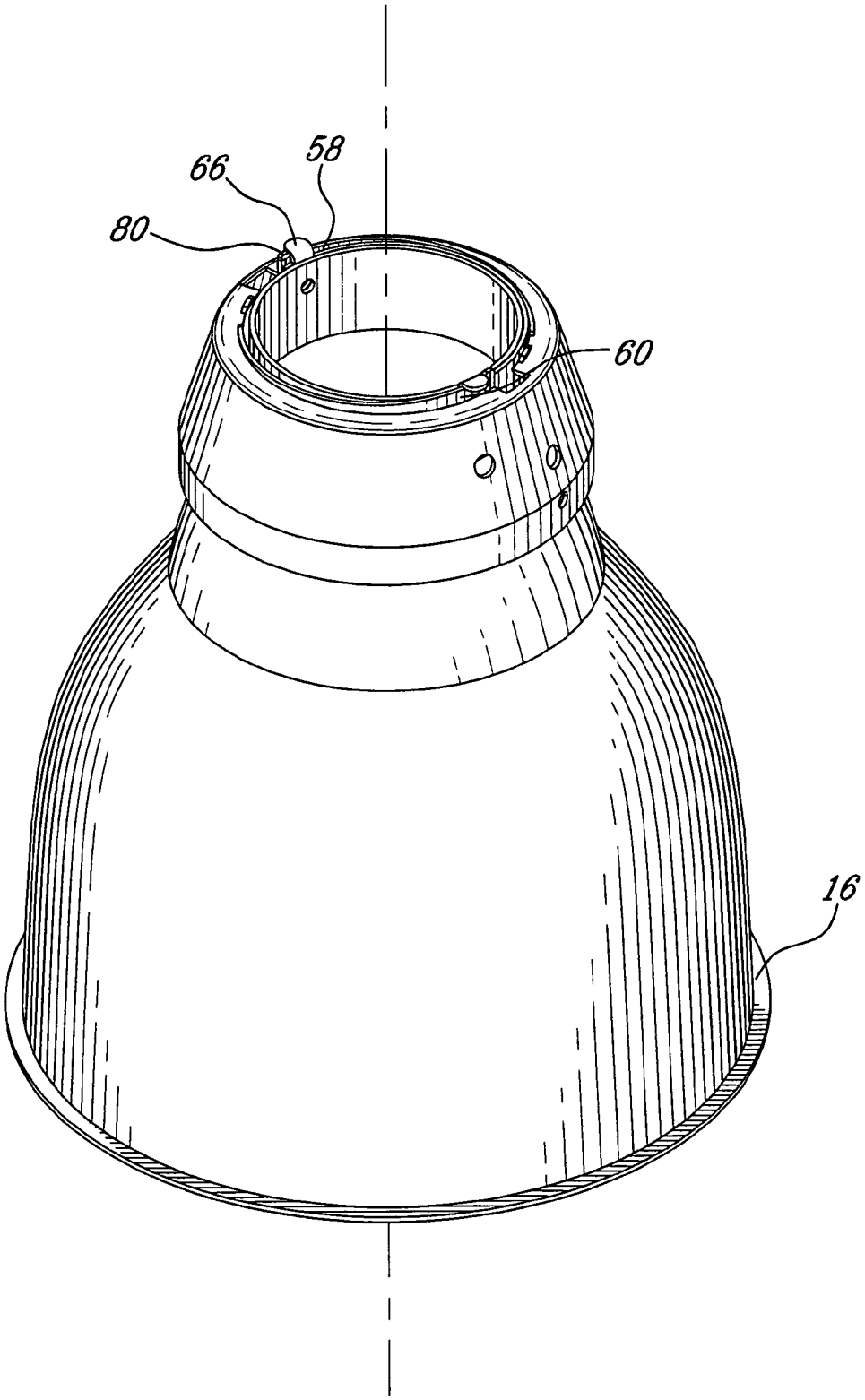
FIG. 6 is a view similar to FIG. 5 after installation.

FIG. 5 shows the upper collar 18 of the light reflector 14 having been inserted through the annular member 46 with the pair of lugs 64 and 66 passing through their corresponding slots 54 and 56 of the annular member. The light reflector is then rotated in the direction indicated by arrow 78 whereby the lugs slide along the helicoidal surface sections 58 and 60 of the annular member. This rotation causes a gradual upward displacement of the light reflector until there is a tight fit of the annular flange 16 within the recessed flange 47 of the lower flange 30 of the reflector where both flanges 16 and 47 become co-planar. However, this rotational sliding of the lugs on their corresponding helicoidally shape surface is limited by the contact of lug 66 with the lug stopping projection 80; a pair of opposite lugs 66 contacting a pair of opposite limiting projections 80 may also be envisaged.

Although the invention has been described with respect to one specific form, it will be evident to a person skilled in the art that it may be modified and refined in various ways. For example, the shape of the upper part of the light reflector and that of the upper part of the light reflector support may vary from that illustrated in the drawings as there are many types of reflectors and supports. It is therefore wished to have it understood that the present invention should not be limited in scope, except by the terms of the following claims.

The invention claimed is:

1. A recessed light fixture assembly for mounting into an opening in a ceiling, wall or the like, comprising:

a light reflector having an upper part and engaging means mounted to said upper part of said light reflector; and a light reflector support adapted to be mounted into said opening of said ceiling, wall or the like; said reflector support having an upper part adapted to engage said upper part of said light reflector; said upper part of said light reflector support having a bearing surface cooperatingly receiving said engaging means of said upper part of said light reflector; said bearing surface of said upper part of said light reflector support having an helicoidal shape whereby rotation of said light reflector, once said upper part of said light reflector bears with said upper part of said light reflector support, enables engagement in one rotational direction and disengagement in an opposite rotational direction, of said light reflector to and from said reflector support and wherein said light reflector support has a lower peripheral annular flange for bearing against a front face area of said ceiling, wall or the like adjacent said opening.

2. A recessed light fixture assembly as defined in claim 1, wherein said engaging means of said light reflector consists of a member secured to said upper part of said light reflector and displaying lug means adapted to slide on said bearing surface of said upper part of said light reflector support.

3. A recessed light fixture assembly as defined in claim 2, wherein said lug means consist of a pair of diametrically opposed lugs and said bearing face displays a pair of diametrically opposed slots to allow passage of said pair of lugs therethrough during engagement and disengagement of said light reflector with said light reflector support.

4. A recessed light fixture assembly as defined in claim 1, wherein said light reflector has a lower peripheral flange and wherein said lower peripheral annular flange of said reflector support includes an inner peripheral recessed area in which is fittingly received said lower peripheral flange of said light reflector during rotation of said light reflector to said light reflector support means so that both flanges are co-planar at engagement.

5. A recessed light fixture assembly as defined in claim 3, wherein said helicoidal surface consists of a pair of opposite helicoidal surface sections to correspondingly receive said pair of lugs thereon.

6. A recessed light fixture assembly as defined in claim 5, wherein at least one of said helicoidal surface sections displays a lug stopping projection at one extremity thereof.

7. A recessed light fixture assembly as defined in claim 1, further comprising a light and a light bulb supporting cap extending over said upper part of said light reflector; said cap including electrical components for said light bulb.

* * * * *